United States Patent [19]

Bowden, Jr. et al.

[11] Patent Number: 4,688,873

[45] Date of Patent: Aug. 25, 1987

[54] ELECTRICAL CONNECTOR DEVICE

[76] Inventors: Wade R. Bowden, Jr., Northport; Yuliy Rushansky, Port Washington, both of N.Y.

[21] Appl. No.: 824,543

[22] Filed: Jan. 31, 1986

[51] Int. Cl.[4] ..... H01R 13/56
[52] U.S. Cl. ..... 439/462 R
[58] Field of Search ..... 339/103 R, 103 C, 17

[56] References Cited

U.S. PATENT DOCUMENTS

| | | | |
|---|---|---|---|
| 3,861,778 | 1/1975 | Capra | 339/103 R |
| 3,905,672 | 9/1975 | Anhalt | 339/103 R |
| 3,989,340 | 11/1976 | Sheldon et al. | 339/103 C |
| 4,053,198 | 10/1977 | Doyle | 339/103 R |
| 4,114,974 | 9/1978 | Laurence | 339/103 C |
| 4,150,250 | 4/1979 | Lundeberg | 179/65 SS |
| 4,284,317 | 8/1981 | Doyle | 339/103 R |
| 4,293,178 | 10/1982 | Lee | 339/103 R |
| 4,390,227 | 6/1983 | Deutsch | 339/103 C |

OTHER PUBLICATIONS

Leviton catalog sheet for SM 12 Spec-Master locking plugs and connectors.

*Primary Examiner*—Eugene F. Desmond
*Attorney, Agent, or Firm*—Morgan & Finnegan; Morgan & Finnegan

[57] ABSTRACT

An improved electrical connector device for coupling to the end of an electrical power cable. The cable is received in a connector housing, passing through a connector body and an apertured collar which is threadably engaged on the connector housing. A particulate shield is located within the connector housing to protect the housing and inner portions of the connector body from the intrusion of particulate matter, such as dust. The shield comprises a series of panel-like leaf segments which circumscribe the cable. The shield cooperates with the collar such that when threaded onto the connector housing, the opening formed by the leaf segments closes around the cable to form a protective covering for the connector housing and connector body.

8 Claims, 9 Drawing Figures

ELECTRICAL CONNECTOR DEVICE

The present invention relates generally to electrical connectors, and more particularly to electrical connector devices having interior portions protected against the intrusion of foreign matter, such as dust and other particulate matter. Although the invention will be described primarily with reference to plug connectors (known commercially as "electrical caps"), it is equally applicable to corresponding receptable connectors (known commercially as "electrical connectors").

A potentially serious danger associated with known commercial electrical connectors, particularly those utilizing a collar chuck cable grasping means, is the risk of electrical fires and short-circuiting caused by the entry of particulate matter, such as dust and the like, into the interior of the connector housing. This danger is increased when the connector device is used with a relatively small diameter cable, which leaves a substantial opening between the cable and the device collar.

Electrical connectors specifically adapted to shield their interiors from the intrusion of dust and other foreign material are known in the art. For example, electrical connectors made by manufacturers such as LEVITON are provided with a thin, flexible nylon membrane molded around the outside of the cable entry hole. The membrane contains a series of slits around its inner periphery which divide the membrane into finger-like sections, said sections being laterally displaceable to accomodate cables of varying diameter. These slits are necessary to accept larger diameter cables since the membrane itself is non-elastomeric, and thus, cannot be stretched to accomodate such cables. A major disadvantage associated with such shielding devices concerns the presence of gaps or openings created in the membrane by these slits, through which particles might travel, when larger diameter cables are received therethrough.

Accordingly, there is a need for commercial electrical caps and connectors provided with gap-less protection against the intrusion of dust and other particulate material, especially through the cable entry end of the device. Such devices should be capable of relatively simple and inexpensive fabrication; enable speedy, secure and simple installation; and should be characterized by safe and durable construction.

It is therefore an object of the present invention to provide a new and improved electrical cap and connector with the capability of shielding its interior conductor terminations and workings from the intrusion of foreign particulate matter.

It is also an object of the invention to provide a new and improved cap and connector device having a particulate shield capable of economical construction; withstanding ordinary commercial wear and tear; and allowing speedy and simple installation and replacement.

It is a further object of the invention to provide a new particulate shield adapted to be conveniently installed inside the housing of an electrical cap and connector device. Advantageously, the shield should not otherwise interfere with the operation of the other working parts of these caps and connectors.

It is yet another object of the invention to provide a new particulate shield all of whose component parts can be fabricated from a moldable plastic material, or any other material suitable for commercial application of the invention as embodied herein.

Objects and advantages of the invention are set forth in part herein and in part will be apparent herefrom, or may be learned by practice with the invention, the same being realized and attained by means of the structures, instrumentalities and combinations pointed out in the appended claims. Accordingly, the invention resides in the novel parts, structures, arrangements, combinations and improvements herein shown and described.

SUMMARY OF THE INVENTION

In the improved electrical connector according to the present invention, a generally hollow and cylindrical connector housing is threaded at one end, and adapted to receive a cable and a conductor body electrically terminated to the cable. A generally hollow and cylindrical collar has reciprocating threads for threadable engagement with the connector housing to engage grasping means within the housing for tighteningly grasping the cable within a variable opening, multi-segmented particulate shield in the connector housing, when the collar is threaded onto the housing. The shield comprises a plurality of panel-like leaf segments which encirclingly overlap to closely surround any size cable during threadable engagement of the collar on the connector housing to protect the interior of the connector housing and the connector body from dust or other particulate debris. The connector housing is adapted to permit slideable placement of the shield therein and to restrain movement of the shield except for radial opening and closing about the cable.

DESCRIPTION OF PREFERRED EMBODIMENT

Figure 1:
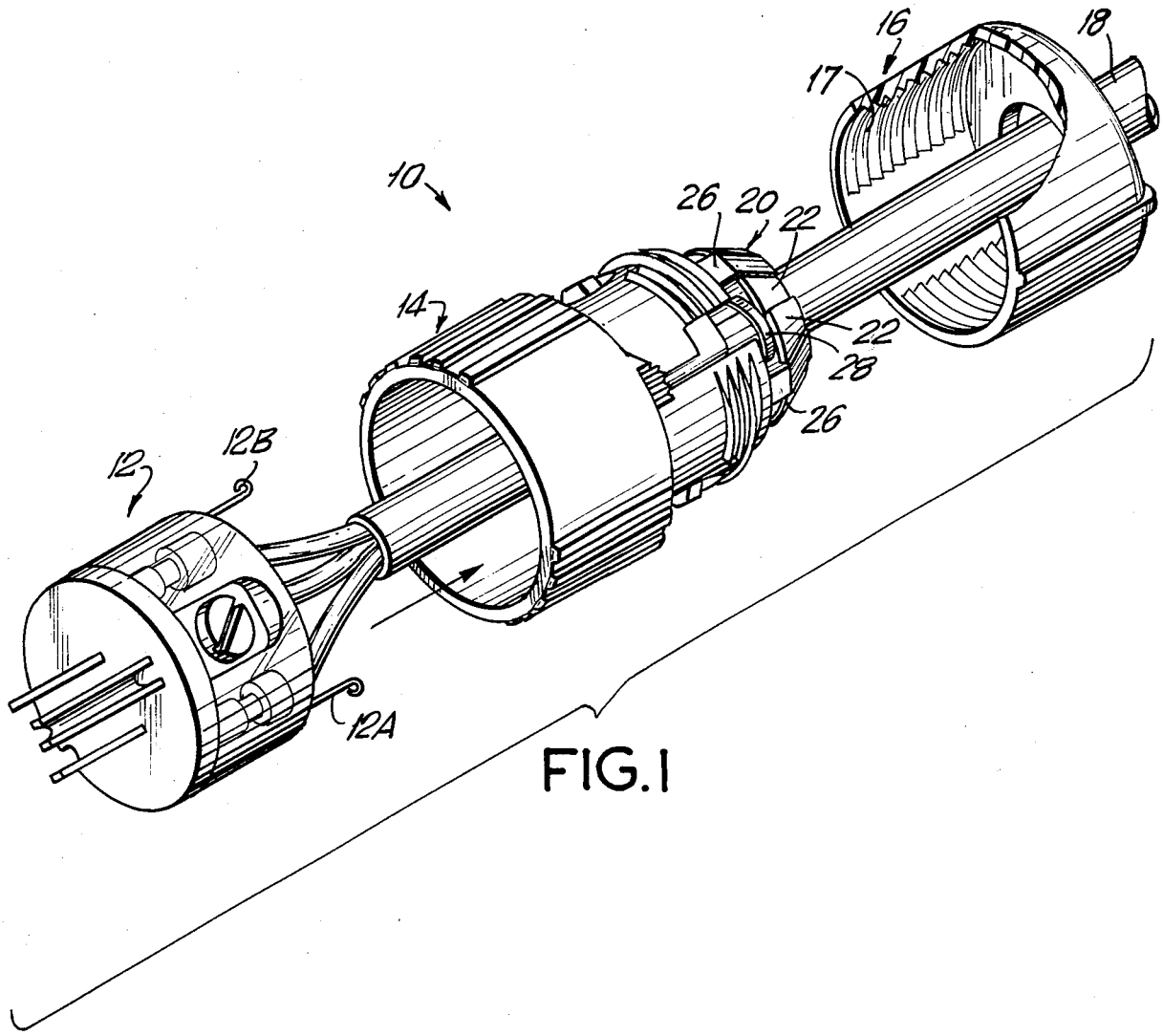
FIG. 1 is an exploded, partially cut-away view in perspective of a preferred embodiment of the present invention.

Referring now to the embodiment of the invention illustrated in the accompanying drawings, wherein like reference characters refer to like parts throughout the various views, there is shown in FIGS. 1–4 a preferred embodiment of the invention.

Referring more particularly to FIG. 1, the electrical connector of the present invention (indicated generally by reference numeral 10) includes connector body 12, connector housing 14, and cylindrical collar 16, adapted for installation on the end of insulated electrical conducting cable 18. Connector body 12 is provided with snap-like quick mounting means for securing connector body 12 within connector housing 14. These mounting means comprise at least two spring clip members 12A mounted to connector body 12 and formed with bead-like rounded ends 12B, adapted to allow connector body 12 to be slidably received in and lockably engaged with connector housing 14. It is to be understood, however, that any other convenient securing means may be used. It will be further understood that connector body 12 includes electrical terminal means for termination to cable 18, and electrical contact means for enabling electrical coupling with a reciprocal connector device. However, inasmuch as the interior details of the connector body are not, in and of themselves, critical to the present invention, there is no need to describe those details herein.

Thus, although connector body 12 is here illustrated as a three-pronged plug (or male coupling element), it will be understood that the present invention is equally applicable to a receptacle connector body (or female coupling element), as well as any other conventional or desirable coupling member. More particularly, connector 10 may be generally of the type illustrated in Doyle et al., U.S. Pat. No. 4,053,198, the disclosure of which is hereby incorporated herein by reference.

Referring now to FIGS. 2, the electrical connector of the present invention includes a particulate shield (indicated generally at 20), slideably positioned in connector housing 14 and adapted to closely surround cable 18 at the cable-entry end of the connector to prevent access by foreign particulate matter to the interior of connector housing 14 and connector body 12. As preferably embodied, particulate shield 20 is constructed of a moldable polypropylene material. It is to be understood, however, that the component parts of shield 20 may be constructed of any other desirable material conducive to the proper operation of the shield as more particularly described hereinafter.

Figure 2A:
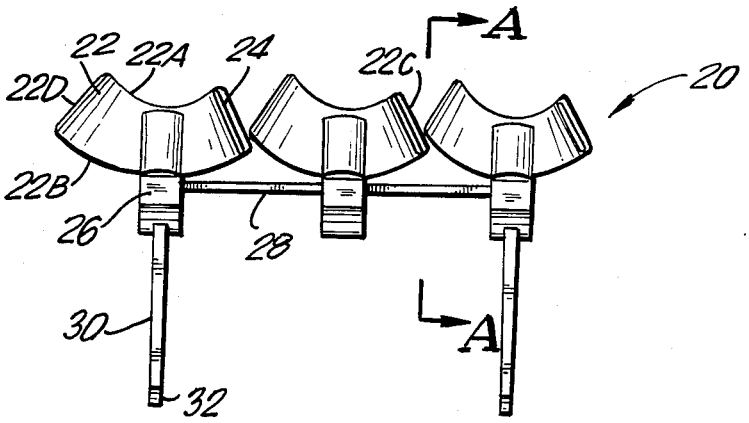
FIG. 2A is a complete layout plan view of a preferred embodiment of the particulate shield according the present invention.
Figure 2B:
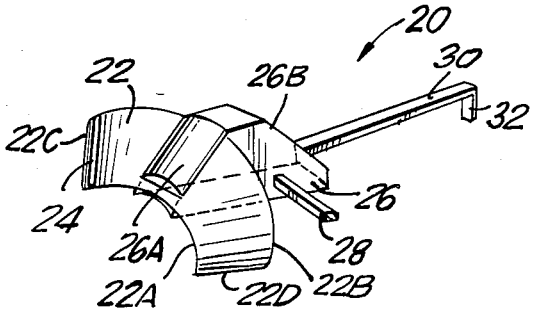
FIG. 2B is a side isometric view through Section A—A of one component part of the particulate shield of the present invention.
Figure 2C:
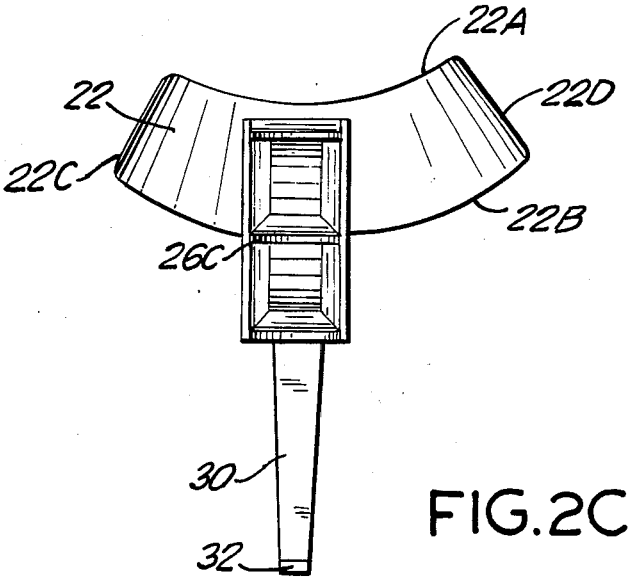
FIG. 2C is a view, looking up from the bottom, of the component part illustrated in FIG. 2B.

Referring now more particularly to FIGS. 2A–2C, there is shown a preferred embodiment of shield 20, which comprises a plurality of panel-like leaf segments 22, each having arcuately-shaped edges 22A and 22B, and outer edges 22C and 22D positioned substantially perpendicular to edges 22A and 22B. According to this embodiment, each leaf segment 22 may be provided with a rib-like projection 24, positioned substantially along outer edge 22C thereof (see FIGS. 2A–2B), to ensure overlapping contact between adjacent leaf segments, and thereby the closure of any gaps therebetween through which particles might travel, when the connector and shield according to the present invention are assembled. As here embodied, there are three sets of leaf segments 22. It is to be understood, however, that the particulate shield of the present invention is adaptable to closely surround any size cable, and, as such, may be constructed with as many leaf segments as practicable and consistent with the invention as embodied herein.

For ease of fabrication and installation, and as a particularly useful embodiment of the present invention, each leaf segment is mounted upon and formed integrally with a cable grasping lug 26, which may be generally similar in design and function to the grasping chucks disclosed in the aforesaid Doyle, et al., U.S. Pat. No. 4,053,198. According to the invention, as preferably embodied, each grasping lug 26 is trapezoidally-shaped (FIG. 2B), having two sides 26A and 26B canted at an acute angle with respect to cable-engaging side 26C, which is preferably of a waffle-shaped configuration for securely gripping cable 18 (FIG. 2C). Advantageously, each leaf segment 22 is integrated with grasping lug 26 along canted side 26A, which is engaged by surface 16A of collar 16 when collar 16 is threaded upon connector housing 14, to ensure tight closure between adjacent leaf segments and maximum shielding effect when the connector and shield according to the present invention are assembled. Furthermore, grasping lugs 26 provide strain relief for cable 18, and, particularly, for the electrical terminal and contact means, as will be more fully described hereinafter.

Figure 4A:
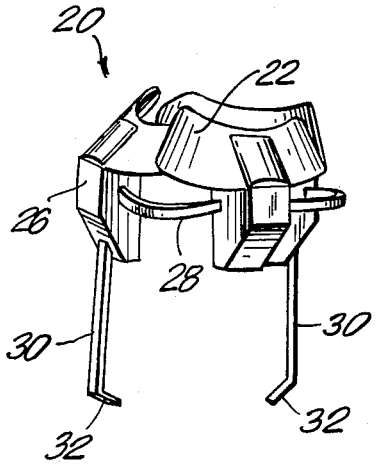
FIG. 4A is an elevation view in perspective of the particulate shield of FIG. 2A as it is to be positioned in the connector housing member.
Figure 4C:
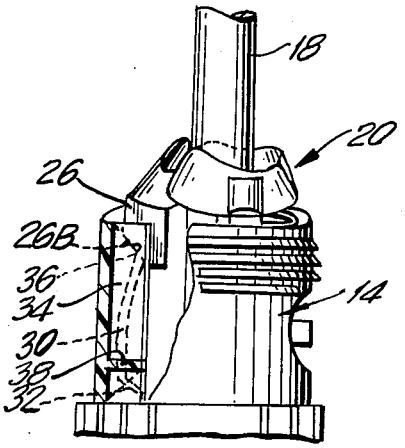
FIG. 4C is a partially cut-away elevation view of the particulate shield of FIG. 2A as positioned in the connector housing member.
Figure 4B:
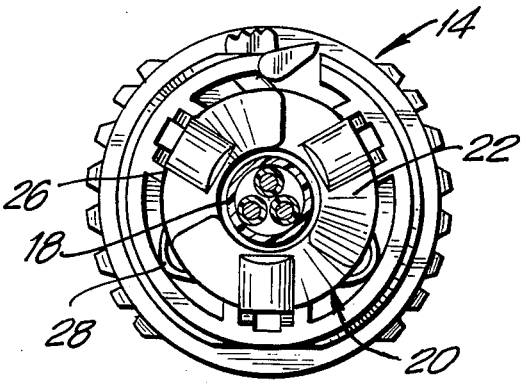
FIG. 4B is a top view of a the connector housing member with the particulate shield of FIG. 2A installed before the collar is threaded upon the connector housing member.

Additionally, and as preferably embodied, grasping lugs 26 are flexibly interconnected by web members 28 (FIG. 2A), the flexure of which enable leaf segments 22 to encirclingly overlap to receive and circumscribe cable 18 when shield 20 is positioned in connector housing 14 in accordance with the invention. It will be appreciated that web members 28 may comprise any pliable material sufficient to facilitate positioning of shield 20 in connector housing 14 as embodied herein. Also, to facilitate proper orientation and retention of shield 20 in connector housing 14, another aspect of this invention provides for a plurality of leg members 30 extending longitudinally downward from grasping lugs 26, and terminating in laterally outwardly extending prong portions 32 (FIGS. 2B, 4A and 4B).

Figure 3:
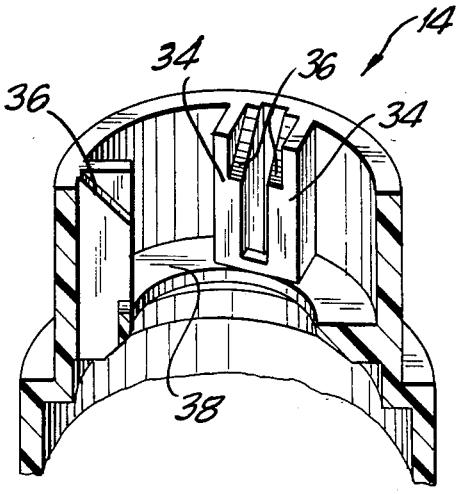
FIG. 3 is a partially cut-away elevation view in perspective of a connector housing member adapted to receive the particulate shield of FIG. 2A according to the present invention.

Advantageously, and as here preferably embodied, connector housing 14 is formed with a plurality of channel-like receiving slots, each defined by sidewalls 34, which serve to receive leg members 30 and retain grasping lugs 26 properly aligned, in a configuration generally parallel to cable 18 (FIG. 3). Each slot is also provided with end ramps 36, formed integrally with sidewalls 34 and oriented at generally the same angle as canted sides 26B on grasping lugs 26. As more fully described hereinafter, ramps 36 are adapted for abutting engagement with sides 26B so as to cause grasping lugs 26 to travel both transversally in the longitudinal direction as well as radially inwardly and downwardly to securely grasp cable 18 when collar 16 is threaded upon connector housing 14. Moreover, connector housing 14 is provided with pier 38 along its inner perimeter, formed integrally with sidewalls 34 (FIG. 3), to engage prong portions 32 and act as a stop to prevent shield 20 from falling out of connector housing 14 during periods when collar 16 is not threaded upon the connector housing.

Referring now to FIGS. 4, there is shown, as preferably embodied, the assembly and operation of particulate shield 20 in the connector device of the present invention. As illustrated in FIG. 4A, web members 28 are flexed to collapse radially outward, thus urging the outermost grasping lug 26/leaf segment 22 assemblies encirclingly inward such that edges 22D of all three leaf segments overlap ribbed edges 22C (FIG.2A) to form an aperture for receiving cable 18, the boundaries of which are defined by arcuate edges 22A. In this configuration, shield 20 is slideably positioned in connector housing 14 (FIG. 4B) such that legs 30 are received between sidewalls 34, with prong portions 32 extending below pier 38 and canted sides 26B of grasping lugs 26 abuttingly engaged with end ramps 36 (FIG. 4C).

Figure 4D:
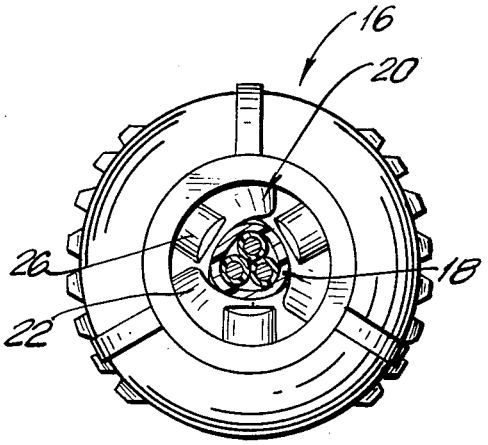
FIG. 4D is a view similar to that of FIG. 4B after the cylindrical collar member is fully threadably engaged on the connector housing member, showing the reduced diameter opening of the particulate shield illustrated in FIG. 2A.

To complete installation and operation, collar 16 is threaded onto connector housing 14 with the grasping lugs and leaf segments engaged therebetween and surrounding cable 18. As collar 16 is threaded onto housing 14, grasping lugs 26 are urged not only in the lateral direction of threading, but also inwardly and downwardly until cable-engaging sides 26C securely grasp cable 18, as canted surfaces 26A and 26B are "squeezed" by, respectively, surface 16A on collar 16 and end ramps 36 on connector housing 14. Thus, as grasping lugs 26 grasp cable 18, the cable is moved inwardly during the last few turns of collar 16 such that connector 10 automatically relieves the strain on cable 18. Further, as lugs 26 are urged inwardly and in the lateral direction of threading, leaf segments 22 are simultaneously urged encirclingly inward in the same direction to converge upon and closely surround cable 18 (FIG. 4D). It will be readily apparent that the encircling movement of leaf segments 22 to closely surround cable 18 is most closely likened to the operation of the shutter mechanism of a camera, or the dilation of the pupils of the human eye. Advantageously, the integration of leaf segments 22 upon canted surfaces 26A facilitates maximum shielding of connector body 12 and connector housing 14 in an "umbrella-like" fashion (FIG. 4A).

It will be readily appreciated, however, that the invention in its broader aspects is not limited to the specific embodiment herein shown and described. Rather, variations may be made therefrom within the scope of the accompanying claims, without departing from the principles of the invention and without sacrificing its chief advantages.

What is claimed is:

1. An electrical connector for coupling to the end of a cable comprising:

a generally cylindrical connector housing, said connector housing being generally hollow and capable of receiving said cable and a connector body, and having thread means formed substantially at one end;

a generally cylindrical collar, said collar being generally hollow to receive said cable and having reciprocal thread means for threadably engaging said thread means on said connector housing;

a multi-segmented particulate shield disposed in said connector housing to receive and circumscribe said cable, and responsive to the threadable engagement of said collar on said connector housing for encirclingly converging upon and closely surrounding said cable to protectively cover the interiors of said connector housing and said connector body, said particulate shield comprising a plurality of discrete segments adapted to overlap each other when said collar and housing are threaded together; and means disposed in said connector housing for positioning and retaining said particulate shield therein.

2. The electrical connector according to claim 1, wherein said particulate shield comprises:

a plurality of panel-like leaf segments, said leaf segments adapted for placement in overlapping contact to form a shutter-like aperture to receive and circumscribe said cable when said particulate shield is positioned in said connector housing; and support and grasping means formed integrally with said leaf segments and positioned between said connector housing and collar members when said members are threadably engaged, said support and grasping means adapted to securely engage said cable and facilitate encircling urging of said leaf segments to converge upon and closely surround said cable as said collar and housing members are threadably engaged by relative rotation therebetween.

3. The electrical connector according to claim 2, wherein each said leaf segment further comprises:

an arcuately-shaped surface edge adapted to substantially abut said cable when said leaf segments are encirclingly urged to closely surround said cable; and a rib-like projection positioned substantially along one surface edge of each said leaf segment to force overlapping contact between adjacent said leaf segments, and ensure the closure of any gaps therebetween, when said particulate shield is positioned in said connector housing to receive and circumscribe said cable.

4. The electrical connector according to claim 3, wherein said support and grasping means comprises:

a plurality of grasping lug members, each said grasping lug member having a first canted side formed integrally with one said leaf segment, and having a second canted side adapted for positioning of said particulate shield in said connector housing;

a plurality of leg members, each said leg member connected at one end to said second canted side of one said grasping lug member for slideable placement of said particulate shield in said connector housing, and each said leg member terminating at the other end in an outwardly extending prong portion; and a plurality of web members, each said web member connected at each end to one said grasping lug member and collapsable radially outward such that said leaf segments may be placed in overlapping contact to receive and circumscribe said cable.

5. The electrical connector according to claim 4, wherein said positioning and retention means comprises:

a plurality of sidewalls vertically disposed along the inner wall of said connector housing, said sidewalls defining channel-like receiving slots for slideably receiving said leg members;

a plurality of end ramps, formed integrally with said sidewalls and adapted for abutting engagement with said second canted surfaces of said grasping lug members; and a pier horizontally disposed along the inner perimeter of said connector housing and formed integrally with said sidewalls to engage said prong portions to prevent slideable movement of said particulate shield in said connector housing.

6. A multi-segmented particulate shield for an electrical connector adapted for coupling to the end of a cable, disposed in the connector housing of said connector to receive and circumscribe said cable, and responsive to the threadable engagement of a cylindrical collar member on said connector housing so as to encirclingly converge upon and closely surround said cable to protectively cover the interiors of said connector housing and a connector body receiveable therein, said particulate shield comprising:

a plurality of panel-like leaf segments, said leaf segments adapted for placement in overlapping contact to form a shutter-like aperture to receive and circumscribe said cable when said particulate shield is positioned in said connector housing; and support and grasping means formed integrally with said leaf segments and positioned between said connector housing and collar members when said members are threadably engaged, said support and grasping means adapted to securely engage said collar and facilitate encircling urging of said leaf segments to converge upon and closely surround said cable as said collar and housing members are threadably engaged by relative rotation therebetween.

7. The particulate shield according to claim 6, wherein each said leaf segment further comprises:

an arcuately-shaped surface edge adapted to substantially abut said cable when said leaf segements are encirclingly urged to closely surround said cable; and a rib-like projection positioned substantially along one surface edge of each said leaf segment to force overlapping contact between adjacent said leaf segments, and ensure the closure of any gaps therebetween, when said particulate shield is positioned in said connector housing to receive and circumscribe said cable.

8. The particulate shield according to claim 7, wherein said support and grasping means comprises:

a plurality of grasping lug members, each said grasping lug member having a first canted side formed integrally with one said leaf segment, and having a second canted side adapted for positioning of said particulate shield in said connector housing;

a plurality of leg members, each said leg member connected at one end to said second canted side of one said grasping lug member for slideable placement of said particulate shield in said connector housing, and each said leg memeber terminating at the other end in an outwardly extending prong portion; and a plurality of web members, each said web member connected at each end to one said grasping lug member and collapsable radially outward such that said leaf segments may be placed in overlapping contact to receive and circumscribe said cable.

* * * * *

UNITED STATES PATENT AND TRADEMARK OFFICE

CERTIFICATE OF CORRECTION

PATENT NO. : 4,688,873

DATED : August 25, 1987

INVENTOR(S) : Wade R. Bowden, Jr., and Yuily Rushansky

It is certified that error appears in the above-identified patent and that said Letters Patent is hereby corrected as shown below:

To indicate the assignee as --Slater Electric, Inc., Glen Cove, N.Y.--;

In Column 1, line 11, the word "receptable" should read --receptacle--;

In Column 2, line 39, the word --to-- should be added between the words according and the;

In Column 2, line 53, the word "a" after the word of should be deleted;

In Column 8, line 17, the word "memeber" should read --member--; and

In Figure 1, reference numeral 17 should be deleted.

Signed and Sealed this

Twenty-seventh Day of September, 1988

*Attest:*

DONALD J. QUIGG

*Attesting Officer*

*Commissioner of Patents and Trademarks*